United States Patent [19]

Ochi et al.

[11] Patent Number: 4,899,658

[45] Date of Patent: Feb. 13, 1990

[54] DELAY TYPE ELECTRIC DETONATOR

[75] Inventors: Koji Ochi, Iwamizawa; Masahide Harada, Sapporo, both of Japan

[73] Assignees: Nippon Oil and Fats Company, Limited, Tokyo; Harada Electronics Industry, Hokkaido, both of Japan

[21] Appl. No.: 254,811

[22] Filed: Oct. 7, 1988

[30] Foreign Application Priority Data

Oct. 16, 1987 [JP] Japan ..... 62-259779

[51] Int. Cl.[4] ..... F42C 11/00

[52] U.S. Cl. ..... 102/206

[58] Field of Search ..... 102/200, 202.1, 202.2, 102/202.3, 202.5, 202.14, 206, 217, 218

[56] References Cited

U.S. PATENT DOCUMENTS

| | | | |
|---|---|---|---|
| 2,976,485 | 3/1961 | Bartz | 102/202.5 |
| 3,675,578 | 7/1972 | Douglas et al. | 102/206 |
| 3,762,331 | 10/1973 | Vlahos | 102/206 |
| 4,145,970 | 3/1979 | Hedberg et al. | 102/206 |
| 4,649,821 | 3/1987 | Marshall et al. | 102/206 |

FOREIGN PATENT DOCUMENTS

| | | | |
|---|---|---|---|
| 2916994 | 11/1983 | Fed. Rep. of Germany . | |
| 2916994 | 11/1983 | Fed. Rep. of Germany . | |
| 205742 | 1/1984 | German Democratic Rep. | 102/206 |

*Primary Examiner*—Charles T. Jordan

*Attorney, Agent, or Firm*—Arnold, White & Durkee

[57] ABSTRACT

An electric detonator of the delay type including a housing having a metal portion and an insulating portion, a pair of leg wires extending outside through the housing, a delay circuit connected across the leg wires and generating an ignition current at a predetermined timing, and an igniting resistor connected to an output terminal of the delay circuit and one of the leg wires. In order to check the resistance value of the igniting resistor even after the detonator has been assembled, a by-pass resistor is connected between the other of the leg wires and a junction point between the delay circuit and the igniting resistor. A small measuring current is conducted through the igniting resistor via the by-pass resistor to generate a voltage drop across the igniting resistor. This voltage drop is measured by connecting a voltage measuring device between the leg wire and the metal portion of the housing.

10 Claims, 2 Drawing Sheets

DELAY TYPE ELECTRIC DETONATOR

BACKGROUND OF THE INVENTION

FIELD OF THE INVENTION AND RELATED ART STATEMENT

The present invention generally relates to a technique for electrically blasting explosives, and more particularly, to a delay type electric detonator for use in a multi-step explosion.

Heretofore, in a multi-step explosion in which a plurality of explosives are fired or ignited at different times delay type electric detonators are generally used. One known delay type electric detonator comprises leg wires to be connected to a bus wire which is connected to an electric blaster, an electric igniting portion including an igniting resistor and a fuse head applied on the igniting resistor, and an electric delay circuit portion having a capacitor for storing the electric energy, an electric delay element and a switching element. At first, the electric energy is stored in the capacitor and when a given time period has elapsed after the actuation of the electric blaster, the switching element becomes conductive and the electric energy is supplied to the igniting resistor via the switching element.

In the electric detonator of the delay type, after the detonator has been assembled, that is to say after the delay circuit and igniting resistor have been installed in a housing together with the igniting resistor and explosive or the housing having the delay circuit installed therein has been coupled with an instantaneous type explosive primer, it is preferable to measure the resistance value of the igniting resistor and to confirm whether the detonator or primer can be ignited properly or not. During transportation of the detonator, the igniting resistor might be disconnected and the contact might become poor or completely broken, so that the resistance value of the igniting resistor might be increased, and further, the igniting resistance might be prolonged or shortened due to the temperature change. Under such a condition, the detonator might not explode correctly. Then, the explosion could not be carried out effectively and some detonators might not explode. This results in a serious danger. Usually the igniting resistor is made of a platinum wire and has a resistance value of about 0.6 Ω. It has been experimentally confirmed that when the resistance of the igniting resistor is increased more than 1.7 Ω, the detonator might not explode. Therefore, the resistance value of the igniting resistor has to be measured with a precision of 0.1 Ω.

In the known electric detonator having the delay circuit, it is impossible to measure the resistance value of the igniting resistor after the detonator has been assembled, so that it is impossible to confirm prior to actual use whether or not the detonator will explode correctly. This is due to the fact that the leg wires are separated from the igniting resistor by means of the switching element provided in the delay circuit. That is to say, if a sufficiently high voltage for making the switching element conductive is applied to the leg wires in order to measure the resistance value of the igniting resistor, the large energy is supplied to the igniting resistor via the switching element and the detonator might accidentally explod. Therefore, conduction of the igniting resistor can not be checked safely. It is considered that a separate checking terminal may be provided on the detonator or a separate checking wire may be added. However, in such a case another problem would be produced in that the detonator might be connected erroneously and the voltage might be applied to the detonator via the checking wire or terminal, and the detonator might explode erroneously.

SUMMARY OF THE INVENTION

The present invention has for its object to provide a delay type electric detonator in which the resistance value of the igniting resistor can be measured safely and accurately without exploding the detonator erroneously.

According to the invention a delay type electric detonator comprises

- a pair of leg wires which are connectable to a bus wire connected to an electric blaster;
- a delay circuit connected across the leg wires and generating at an output terminal an igniting current at a predetermined time
- an igniting resistor connected across the output of the delay circuit and one of the leg wires, and igniting the detonator when said igniting current passes through the igniting resistor; and
- a by-pass means connected between the other of the leg wires and the igniting resistor and conducting a measuring current through the igniting resistor, said measuring current being smaller than said igniting current;

whereby a terminal voltage generated across the igniting resistor by flowing the measuring current through the igniting resistor is measurable from the exterior of the detonator.

In the delay type electric detonator according to the invention, since the measuring current can be conducted through the igniting resistor by means of the by-pass means, the resistance value of the igniting resistor can be measured without passing the measuring current through the delay circuit even after the detonator has been assembled. In this manner, any detonators which might operate erroneously can be removed prior to the actual detonating operation. Further, the measuring current passing through the igniting resistor can be made sufficiently smaller than the usual igniting current, and thus the detonator is never exploded accidently during the measurement.

DESCRIPTION OF THE PREFERRED EMBODIMENTS

Figure 1:
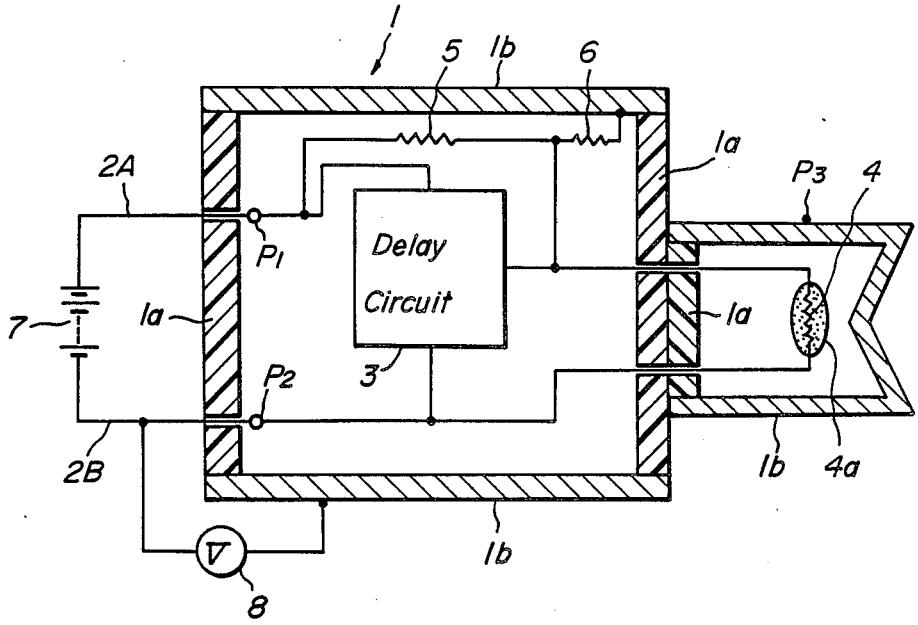
FIG. 1 is a circuit diagram showing a first embodiment of the delay type electric detonator according to the invention.

FIG. 1 is a circuit diagram showing a first embodiment of the delay type electric detonator according to the invention. The electric detonator comprises a cylindrical housing 1 having insulating portions 1*a* and metal portions 1*b*. A pair of leg wires 2A and 2B are connected to input terminals $P_1$ and $P_2$, and a delay circuit 3 is connected across the leg wires. In the usual operation, the delay circuit 3 generates the igniting energy at its output terminal at a predetermined time.

The output terminal of the delay circuit 3 is connected to an igniting resistor 4 via insulating portion 1*a* of the housing 1. The igniting resistor 4 has a fuse head 4*a* applied thereon. In the present embodiment, between the input terminal $P_1$ and the igniting resistor 4 there is connected a by-pass resistor 5 having a resistance value of 470 kΩ. There is further provided a protection resistor 6 connected between a junction point of the resistors 4 and 5 and a metal portion 1*b* of the cylindrical housing 1.

When a measuring voltage is applied from a D.C. voltage supply source 7 to the input terminals $P_1$ and $p_2$ via the leg wires 2A and 2B, said measuring voltage being lower than the nominal operation voltage of the delay circuit 3, a measuring current flows through the igniting resistor 4 through the by-pass resistor 5. In this case, since that terminal of the igniting resistor 4 which assumes a higher voltage is connected to the metal portion 1*b* through the protection resistor 6, it is possible to detect the terminal voltage across the igniting resistor 4 by connecting a voltage measuring circuit 8 across the metal portion 1*b* and one of the leg wires 2B, and then the resistance value of the igniting resistor 4 can be calculated from the measured terminal voltage.

Figure 2:
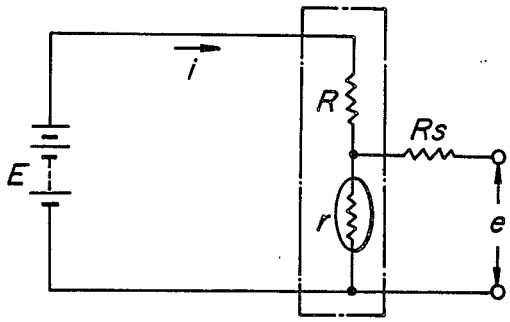
FIG. 2 is an equivalent circuit for explaining the principle of measuring the resistance value of the igniting resistor.

Now the principle of measuring the resistance of the igniting resistor 4 will be explained in detail with reference to FIG. 2. In FIG. 2, R represents the resistance value of the by-pass resistor 5, $R_s$ the resistance value of the protection resistor 6, r the resistance value of the igniting resistor 4, E the amplitude of the measuring voltage applied from the D.C. voltage source 7, e the terminal voltage across the igniting resistor 4 and i denotes the measuring current passing through the by-pass resistor 5. When the measuring current i flows through the igniting resistor 4, the terminal voltage e across the igniting resistor 4 may be expressed by the following equation (1).

$$e = \frac{r}{R + r} E \tag{1}$$

Since R and E are known, it is possible to measure the resistance value r of the igniting resistor 4 by measuring the terminal voltage e. If the igniting resistor 4 is disconnected from the leg wires, the terminal voltage e becomes equal to the measuring voltage E.

$$e = E \tag{2}$$

It should be noted that the resistance value R of the by-pass resistor 5 has to be selected such that the measuring current i becomes sufficiently smaller than the minimum operation current at which the detonator is exploded stably. In the present embodiment, the minimum operation current is about 0.3 A. For instance, the measuring current is preferably set smaller than 10 mA, i.e. $i < 10$ mA. Since the resistance value r of the igniting resistor 4 is very small such as about 0.6 Ω, the measuring current i may be represented as follows.

$$i = \frac{r}{R + r} E \simeq \frac{E}{R} \tag{3}$$

In this equation (3), if $i = 10$ mA and $E = 1.5$ V, there may be obtained the following equation (4).

$$R = \frac{1.5}{10 \times 10^{-3}} = 150\Omega \tag{4}$$

Therefore, the resistance value R of the by-pass resistor 5 should be set sufficiently higher than 150 Ω. In the present embodiment, the resistance value R of the by-pass resistor 5 is set to 470 kΩ by taking into account of the fact that the normal operation of the delay circuit 3 is not affected. The voltage measured by the voltage measuring circuit 8, i.e., the terminal voltage e of the igniting resistor 4 which has the nominal value of 0.6 Ωmay then be expressed as follows:

$$e = \frac{0.6 \times 1.5}{470 \times 10^3 + 0.6} \simeq 1.9\ (\mu V) \tag{5}$$

If the resistance value r of the igniting resistor 4 is 1.7 Ω, the terminal voltage e becomes nearly equal to 5.4 μV. In this manner, by measuring the terminal voltage e after amplifying it in the voltage measuring circuit 8, a very small change of the resistance value r of the igniting resistor 4 can be measured accurately. When the igniting resistor 4 is disconnected, the terminal voltage e becomes equal to 1.5 V according to the equation (2).

In this manner, according to the invention, after the electric detonator has been assembled, the resistance value r of the igniting resistor 4 is measured to confirm or check whether the electric detonator is exploded correctly or not. That is to say, by checking the measured resistance value r of the igniting resistor 4, it is possible to detect the loss or decrease of the electric conduction of the igniting resistor due to the vibration and shock during the transportation and usage and the very small variation of the resistance value r due to the expansion and shrinkage of the igniting resistor. Therefore, any electric detonators which might not be exploded correctly can be removed prior to the actual detonating operation. In this manner, the explosion can be carried out reliably and safely.

It should be noted that although it is possible to detect whether or not the igniting resistor is disconnected by connecting a usual tester across the metal portion 1*b* of the housing 1 and the leg wire 2B, it is difficult to measure the resistance value r of the igniting resistor precisely. According to the invention, since the terminal voltage across the igniting resistor is measured, the variation of the resistance value of the igniting resistor can be detected accurately.

When electrostatic charge (for instance, 8 kV) is stored on the metal portion 1*b* of the housing 1, the electric energy might be discharged through the igniting resistor 4 at that point of the metal portion which is nearest to the igniting resistor, for instance, at a point $P_3$ in FIG. 1, and the electric detonator might be accidentally exploded. In the present embodiment, the above mentioned drawback can be prevented by providing the protection resistor 6. In this case, it is preferable that the protection resistor 6 has a low resistance value in order to suppress the discharge current to a small value as well as to prevent accidental explosion if a high voltage is erroneously applied across the leg wire 2B and the metal housing portion 1*b*, the protection resistor has preferably a resistance as high as possible. However, if the resistance value $R_s$ of the protection resistor is set too high, the accuracy of the measurement would be decreased. Therefore, it is preferable to set the value $R_s$ to a value within a range of 50–150 kΩ. In the present embodiment, the resistance value $R_s$ of the protection resistor 6 is set to 100 kΩ.

Figure 3:
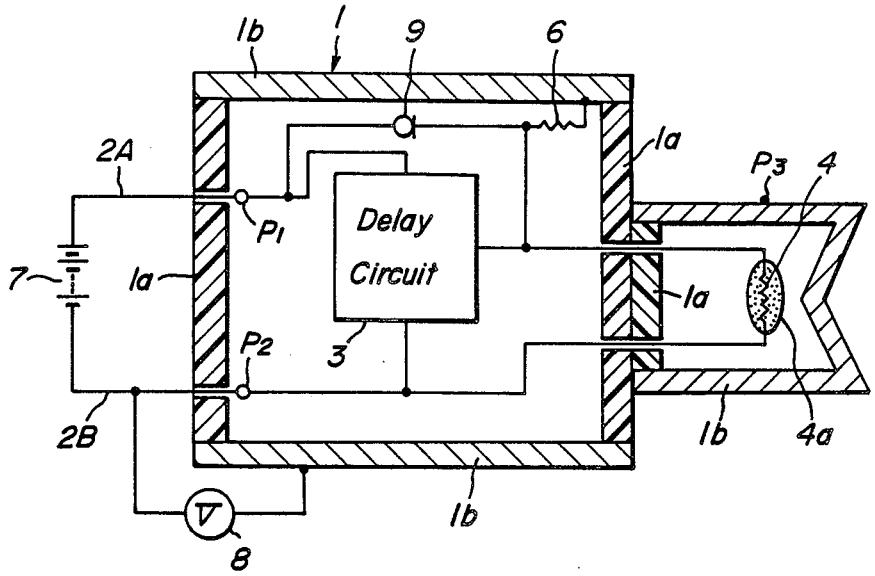
FIG. 3 is a circuit diagram illustrating a second embodiment of the delay type electric detonator according to the invention.

FIG. 3 shows a second embodiment of the electric detonator according to the invention. In this embodiment, portions similar to those shown in FIG. 1 are denoted by the same reference numerals used in FIG. 1. In the second embodiment, the by-pass resistor 5 in the first embodiment is replaced by a constant current element, for instance, a constant current diode 9.

As explained above, the igniting resistor 4 has the nominal resistance value r of about 0.6 Ω, and when the resistance value of the igniting resistor becomes higher than 1.7 Ω, the detonator might not explode correctly. Therefore, the resistance of the igniting resistor has to be measured with a precision of about 0.1 Ω. In the first embodiment, when the resistance value R of the by-pass resistor 5 fluctuates by about ±10%, the terminal voltage e might be fluctuated by 0.3 μV, and the necessary measuring precision of 0.1 Ωcould not be attained. In the present embodiment, use is made of the constant current diode 9 instead of the by-pass resistor, the measuring current i can be remained constant. By using the constant current element, even a very small change of the resistance value of the igniting resistor made of platinum due to the variation in the temperature can be measured precisely.

Figure 4:
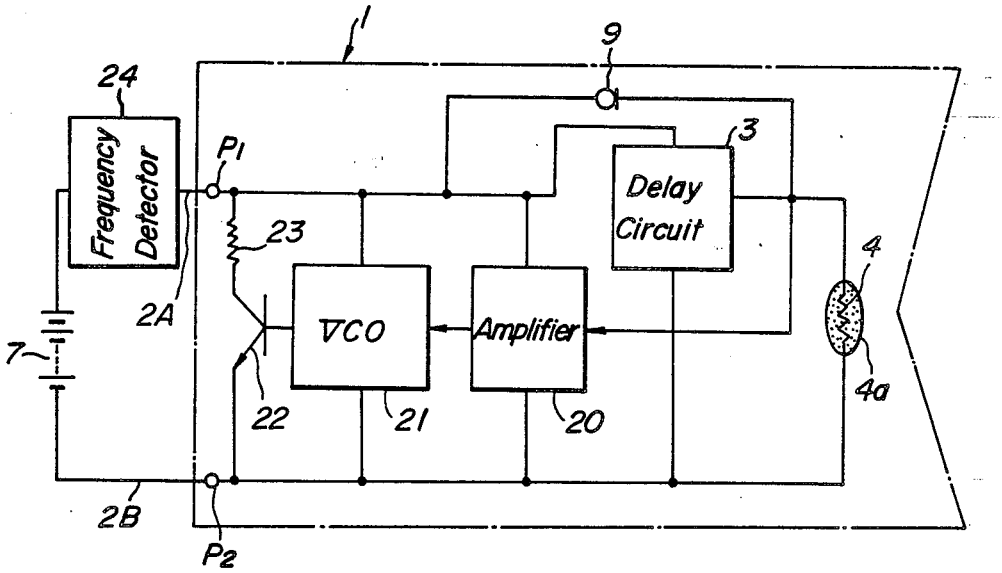
FIG. 4 is a circuit diagram depicting a third embodiment of the delay type electric detonator according to the invention.

FIG. 4 illustrates a third embodiment of the electric detonator according to the invention. Also in this embodiment, portions similar to those illustrated in FIG. 1 are represented by the same reference numerals shown in FIG. 1.

In the third embodiment, the electric detonator of the delay type comprises leg wires 2A, 2B connected to input terminals $P_1$, $P_2$, respectively provided within the tubular housing 1, delay circuit 3 connected in parallel with the leg wires and generating the ignition energy at a predetermined time, igniting resistor 4 connected between the output of the delay circuit and the leg wire 2B, fuse head **4*a* applied on the igniting resistor, constant current diode 9 for constituting the by-pass means between the leg wire 2A and the igniting resistor 4, amplifier circuit 20 having the power supply inputs connected to the leg wires 2A and 2B and an input terminal connected to a junction point between the constant current diode 9 and the igniting resistor for amplifying the terminal voltage across the igniting resistor, voltage controlled oscillator (VCO) 21 connected across the leg wires 2A and 2B and having a control input terminal connected to an output terminal of the amplifier 20 for generating a pulse whose repetition frequency corresponds to the output voltage of the amplifier, and NPN transistor 22 having a base connected to the output of the voltage controlled oscillator, a collector coupled with the leg wire 2A via a resistor 23 and an emitter connected to the leg wire 2B**.

In order to measure the resistance value of the igniting resistor 4, the measuring voltage is applied to the input terminals $P_1$ and $p_2$ via the leg wires 2A and 2B from the D.C. voltage source 7. The measuring voltage has such an amplitude that the delay circuit 3 is not operated, but the amplifier 20 and voltage controlled oscillator 21 are operated. Then, the constant measuring current flows through the igniting resistor 4 via the constant current diode 9 to generate the terminal voltage across the igniting resistor. This terminal voltage is amplified by the amplifier 20 and then is applied to the control input of the voltage controlled oscillator 21. Therefore, the voltage controlled oscillator 21 generates a pulsatory voltage whose amplitude corresponds to the terminal voltage across the igniting resistor, i.e. the resistance value of the igniting resistor. This output voltage is applied to the base of the transistor 22. In this manner, between the emitter-collector passage of transistor 22, there is produced the pulsatory current whose repetition frequency corresponds to the resistance value of the igniting resistor between the emitter and collector, i.e. between the leg wires 2A and 2B. In the present embodiment, the frequency detector 24 is provided between the positive terminal of the D.C. voltage source 7 and the leg wire 2A. The frequency detector 24 includes a filter for detecting the frequency of the current passing therethrough and a calculating circuit for deriving the resistance value of the igniting resistor 4 from the detected frequency.

The third embodiment of the electric detonator according to the invention has a special merit that the resistance value of the igniting resistor 4 can be measured by connecting the D.C. voltage supply source 7 and frequency detector 24 to the leg wires 2A and 2B even after the leg wires are connected to the bus wire either in series or parallel therewith. Therefore, the resistance value of the igniting resistor can be checked immediately before the actual detonating operation.

The present invention is not limited only to the embodiments explained above, but many alternations and modifications can be conceived by those skilled in the art within the scope of the invention. For instance, in the first embodiment, the resistance values of the resistors 5 and 6 are set to 470 kΩ and 100 kΩ, respectively, but they may have any other values as long as the above explained conditions are satisfied. In the third embodiment, the voltage controlled oscillator 21 may be constituted such that when the igniting resistor 4 is conductive, the oscillator can oscillate, but when the igniting resistor is broken, the oscillator does not oscillate. Then, the condition of the igniting resistor can be judged immediately. This modification may be preferably applied to the case that a large number of electric detonators have been connected to the bus wire. The circuit construction just explained above may be equally applied to the electric primer of the delay type.

As explained above in detail, according to the invention, the resistance value of the igniting resistor can be measured by flowing the measuring current through the igniting resistor via the by-pass circuit means and detecting the terminal voltage across the igniting resistor. Therefore, the abnormal condition of the resistance value of the igniting resistor can be accurately detected after the electric detonator has been assembled and after the electric detonators have been connected to the bus wire. Therefore, any detonators which might not explode correctly can be removed prior to the actual detonating operation, and the explosion can be carried out reliably and safely.

What is claimed is:

1. A delay type electric detonator comprising:

a pair of leg wires which are connectable to a bus wire connected to an electric blaster;

a delay circuit connected across the leg wires and generating at an output terminal an igniting current at a predetermined time;

an igniting resistor connected across the output of the delay circuit and one of the leg wires, and igniting the detonator when said igniting current passes through the igniting resistor; and by-pass means connected between the other of the leg wires and the igniting resistor and conducting a measuring current through the igniting resistor, said measuring current being smaller than said igniting current;

whereby a terminal voltage generated across the igniting resistor by flowing the measuring current through the igniting resistor is measurable from the exterior of the detonator.

2. A detonator according to claim 1, wherein said by-pass means comprises a resistor.

3. A detonator according to claim 2, wherein said resistor has such a resistance value that the measuring current flowing through the igniting resistor is made smaller than 10 mA.

4. A detonator according to claim 3, wherein said resistor has a resistance value of 470 kΩ.

5. A detonator according to claim 1, wherein said by-pass means comprises a constant current element.

6. A detonator according to claim 5, wherein said constant current element is formed by a constant current diode.

7. A detonator according to claim 1, further comprising a housing including a metal portion and an insulating portion, and a protection resistor connected between a junction point between the by-pass means and the igniting resistor and the metal portion of the housing.

8. A detonator according to claim 7, wherein said protection resistor has a resistance value of 50–150 kΩ.

9. A detonator according to claim 8, wherein said protection resistor has a resistance value of 100 kΩ.

10. A detonator according to claim 1, further comprising an amplifier having power supply input terminals connected across the leg wires, an input terminal connected to a junction point between the by-pass means and the igniting resistor and an output terminal, a voltage controlled oscillator having power supply input terminals connected to the leg wires, an input terminal connected to the output terminal of the amplifier and an output terminal for generating a pulse whose repetition frequency corresponds to the terminal voltage across the igniting resistor, and a transistor having an emitter-collector passage connected across the leg wires and a base connected to the output terminal of the voltage controlled oscillator, whereby the resistance value of the igniting resistor is measured by detecting a repetition frequency of a pulsatory current passing through the leg wires.

* * * * *